US008484948B2

(12) United States Patent
Kozal

(10) Patent No.: US 8,484,948 B2
(45) Date of Patent: Jul. 16, 2013

(54) FIXED AUGER ASSEMBLY

(75) Inventor: Michael D. Kozal, Caledonia, MI (US)

(73) Assignee: Pridgeon & Clay, Inc., Grand Rapids, MI (US)

( * ) Notice: Subject to any disclaimer, the term of this patent is extended or adjusted under 35 U.S.C. 154(b) by 947 days.

(21) Appl. No.: 12/531,089

(22) PCT Filed: Mar. 15, 2008

(86) PCT No.: PCT/US2008/057170

§ 371 (c)(1),
(2), (4) Date: Sep. 14, 2009

(87) PCT Pub. No.: WO2008/115841

PCT Pub. Date: Sep. 25, 2008

(65) Prior Publication Data

US 2010/0037593 A1 Feb. 18, 2010

Related U.S. Application Data

(60) Provisional application No. 60/895,245, filed on Mar. 16, 2007.

(51) Int. Cl.
*F01N 3/00* (2006.01)

(52) U.S. Cl.
USPC ..... 60/286; 60/274; 60/295; 60/303; 60/324

(58) Field of Classification Search
USPC ..... 60/282, 286, 288, 295, 303, 324
See application file for complete search history.

(56) References Cited

U.S. PATENT DOCUMENTS

| | | | | |
|---|---|---|---|---|
| 2,911,055 | A | 11/1959 | McDonald | |
| 3,817,714 | A | 6/1974 | Wiley | |
| 2002/0100167 | A1 * | 8/2002 | Hardesty et al. | 29/890 |
| 2006/0150614 | A1 * | 7/2006 | Cummings | 60/275 |

* cited by examiner

*Primary Examiner* — Thomas Denion
*Assistant Examiner* — Diem Tran
(74) *Attorney, Agent, or Firm* — McGarry Bair PC

(57) ABSTRACT

A fixed auger assembly (10) comprises a pair of identical auger blades (12, 14) mounted within an auger casing (16). The auger casing (16) includes two end sections, (18, 20) which are substantially identical, with the exception that one end section (20) is formed with a flared edge (38) to partially receive the other end section. The auger blades (12, 14) include a peripheral annular lip (24) which is used to affix the auger blades within the auger casing. The auger blades (12, 14) and the end sections (18, 20) are preferably assembled using a welding process.

16 Claims, 4 Drawing Sheets

FIXED AUGER ASSEMBLY

CROSS-REFERENCE TO RELATED APPLICATIONS

This application is the national phase application from International Application No. PCT/US2008/057170, filed Mar. 15, 2008, which claims the benefit of U.S. Provisional Patent Application No. 60/895,245, filed Mar. 16, 2007, both of which are incorporated herein in their entireties.

BACKGROUND OF THE INVENTION

1. Field of the Invention

The invention relates to a fixed auger assembly for generating turbulent air flow in an exhaust air stream of a diesel engine.

2. Description of the Related Art

In combustion exhaust streams, urea, also known as carbamide, can be used as a nitrogen oxide (NO and $N_2O$, which are together called $NO_x$) reducing agent. For example, in diesel engines, urea is injected into the exhaust air stream to control $NO_X$ emissions. The injected urea decomposes to ammonia upon heating, which reacts with $NO_X$ across a catalyst located downstream of the injection point to reduce the amount of $NO_X$ in the exhaust air stream. The reaction produces water, nitrogen, and carbon dioxide ($CO_2$), which are relatively harmless as air pollutants as compared with $NO_X$. It is known to use a fixed auger to generate turbulent air flow and increase mixing between the urea and the exhaust air stream before exposure to the catalyst.

Prior art augers comprise a pair of auger blades welded to a shaft, which is then inserted into a tubular casing. Typically, the auger blades are fixed within the tubular casing by spot welding the edges of the auger blades to the inside of the tubular casing. Then, a reducer (a truncated cone section) is welded to each end of the tubular casing to enable coupling of the auger to the exhaust line. Extensive time and labor is required to assemble all of these components. Furthermore, the weld bead created by the spot welding process used to attach the edges of the auger blades to the inside of the tubular casing is exposed to the corrosive exhaust air stream containing urea, and can eventually fail.

SUMMARY OF THE INVENTION

A simplified fixed auger assembly (10) is provided. According to the invention, the fixed auger assembly (10) comprises a pair of identical auger blades (12, 14) mounted within an auger casing (16). The auger casing (16) includes two end sections, (18, 20) which are substantially identical, with the exception that one end section (20) is formed with a flared edge (38) to partially receive the other end section (18). The auger blades (12, 14) preferably include a peripheral annular lip (24) which is used to affix the auger blades within the auger casing. The auger blades (12, 14) and the end sections (18, 20) are preferably assembled using a welding process.

DESCRIPTION OF THE PREFERRED EMBODIMENT

Figure 1:
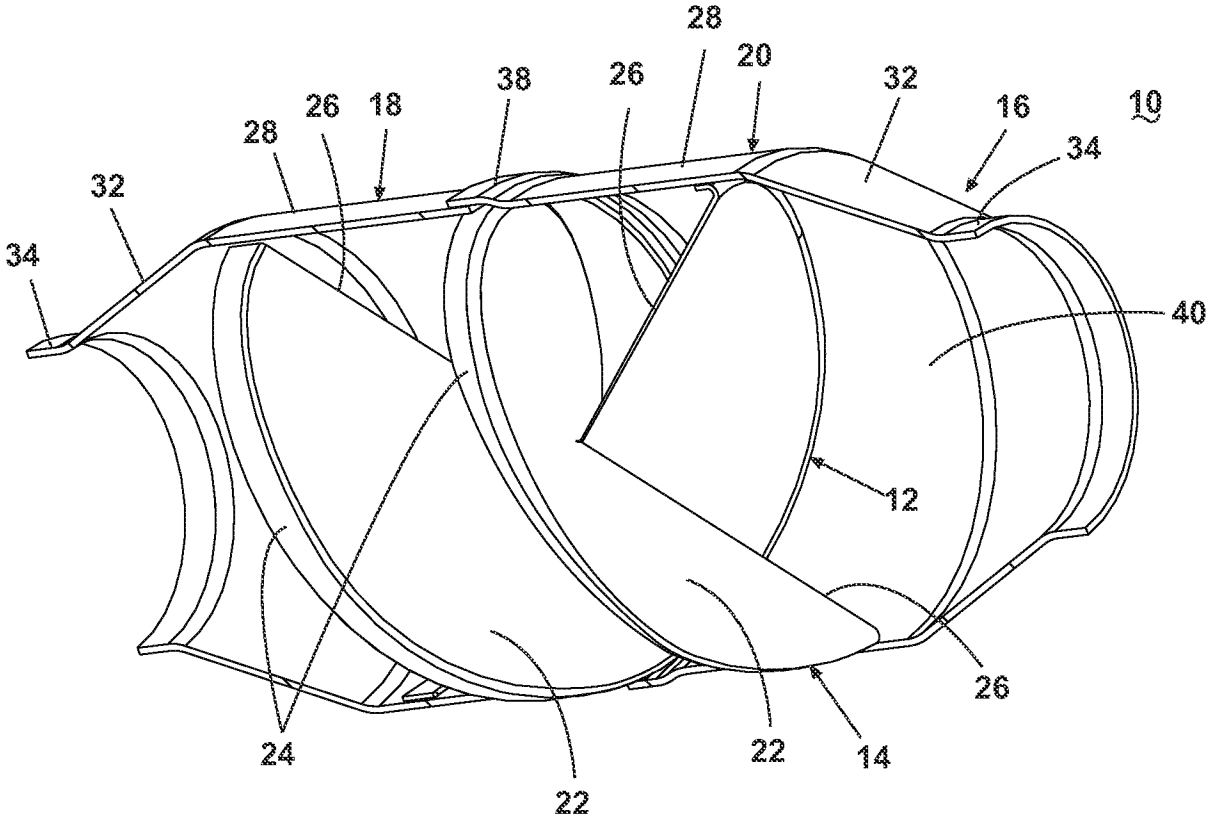
FIG. 1 is a perspective view of a fixed auger assembly according to the invention, including a two-part auger casing, with a portion of the auger casing removed to illustrate a pair of auger blades.

Referring to FIG. 1, a fixed auger assembly 10 for installation in an exhaust line of a diesel or other combustion engine according to the present invention is illustrated. The fixed auger assembly 10 comprises two auger blades 12, 14 affixed within a hollow auger casing 16. The auger casing 16 is formed in two parts and includes a first end section 18, which, in operation, is in fluid communication with an injector for injecting urea into the exhaust air stream and an atomizer for converting the urea to a fine spray, both of which are positioned upstream of the fixed auger assembly 10, and a second end section 20, which, in operation, is in fluid communication with a catalytic converter for treating the exhaust air stream with a catalyst before it enters the environment, which is positioned downstream of the fixed auger assembly 10. It is understood that the end sections 18, 20 are essentially identical, and that either end section 18, 20 can be positioned upstream of the other when installed in an exhaust line.

Figure 2:
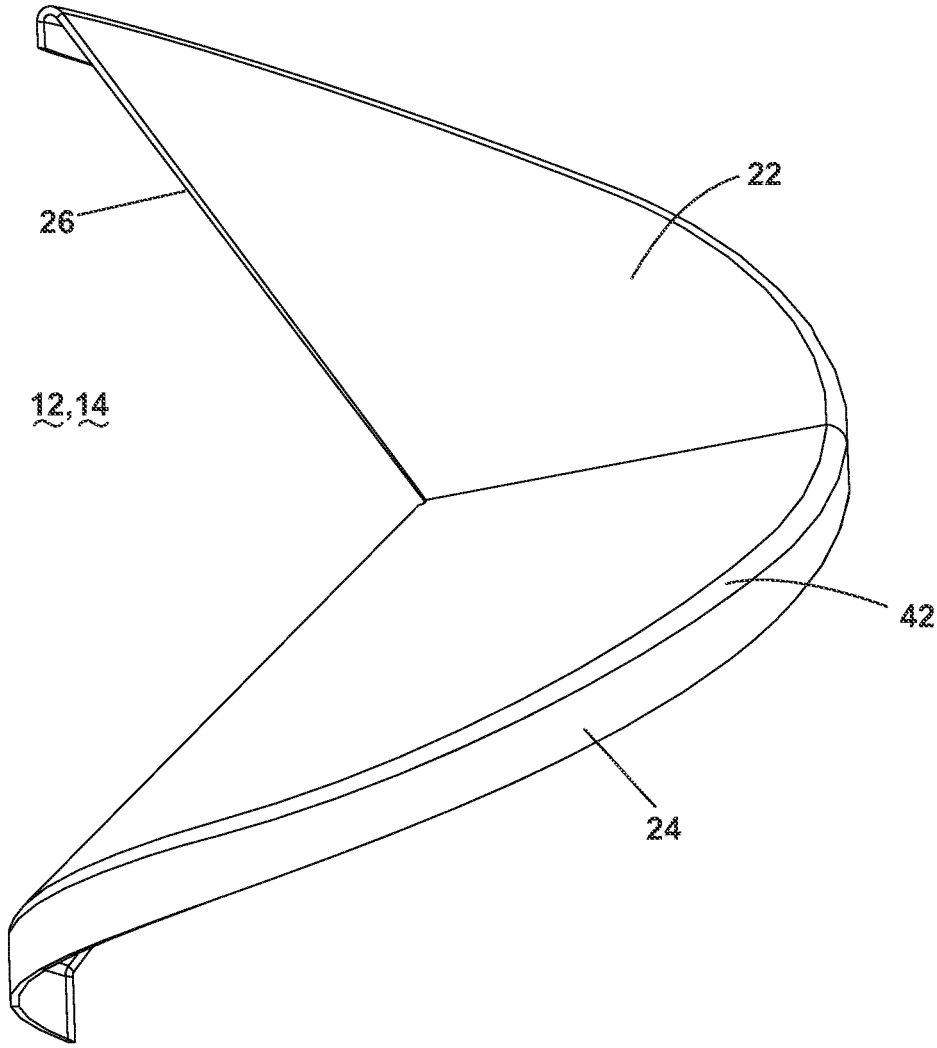
FIG. 2 is a perspective view of one of the auger blades.
Figure 4:
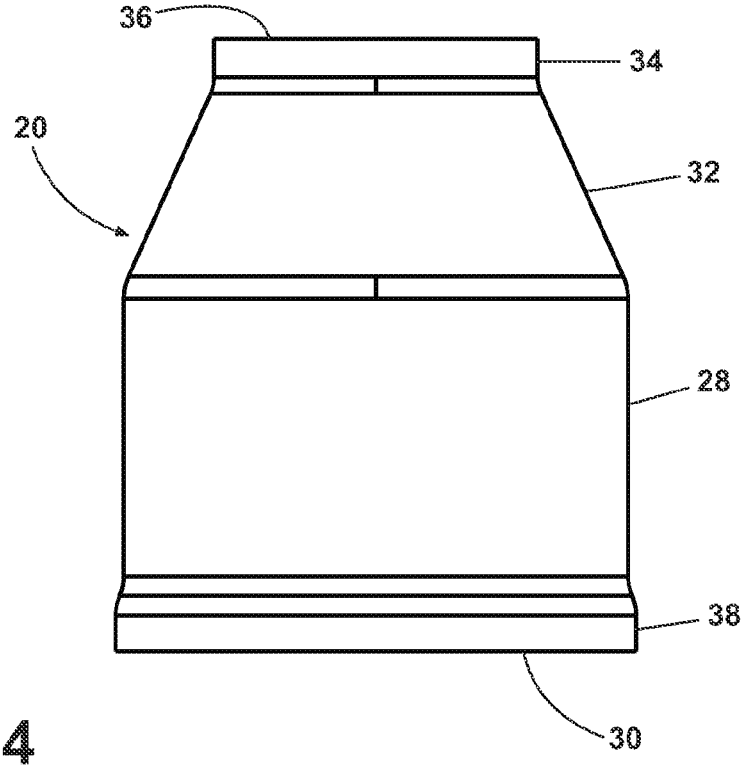
FIG. 4 is a side view of second end section of the auger casing.

Each auger blade 12, 14 is substantially identical and comprises an auger plate 22 having an annular lip 24 along a portion of the periphery of the auger plate 22 and a blade edge 26 along the remainder of the periphery of the auger plate 22. The auger plate 22 is curved so that the auger blades 12, 14 are helicoidal in shape. Preferably, the spiral of each auger blade is 360° or less. More preferably, the spiral angle of each blade 12, 14 is between 270° and 360°. The auger blades 12, 14 are preferably formed by a stamping a metal plate to the shape illustrated in FIG. 2. For example, a single circular plate can be stamped so that the annular 24 is formed at the periphery of the plate with a radiused corner 42, and a cut is made through the annular along a radius of the circle to the center. Simultaneously (or later) the blade edges 26 on either side of the cut can be urged in opposite directions to form a 360° auger blade of the type shown in FIG. 2. If, instead of a single cut, a wedge is removed from the circular plate in the stamping process, the resultant auger blade 12, 14 will have a spiral with an angle of 360° less the angle of the wedge. Looking again at FIG. 1, it will be seen that the in the fixed auger assembly 10, the auger blades 12, 14 are oriented with respect to one another to form a helical air flow path through the auger casing 16 that will generate turbulent air flow and promote mixing between the urea and the exhaust air stream flowing through the fixed auger assembly 10. Preferably, the auger blades 12, 14 are disposed facing each other with their respective centers coincident, thus forming the helical air flow path. Preferably, the auger blades 12, 14 are formed from a 300 series stainless steel to resist corrosion caused by exposure to the urea injected into the exhaust air stream.

Figure 3:
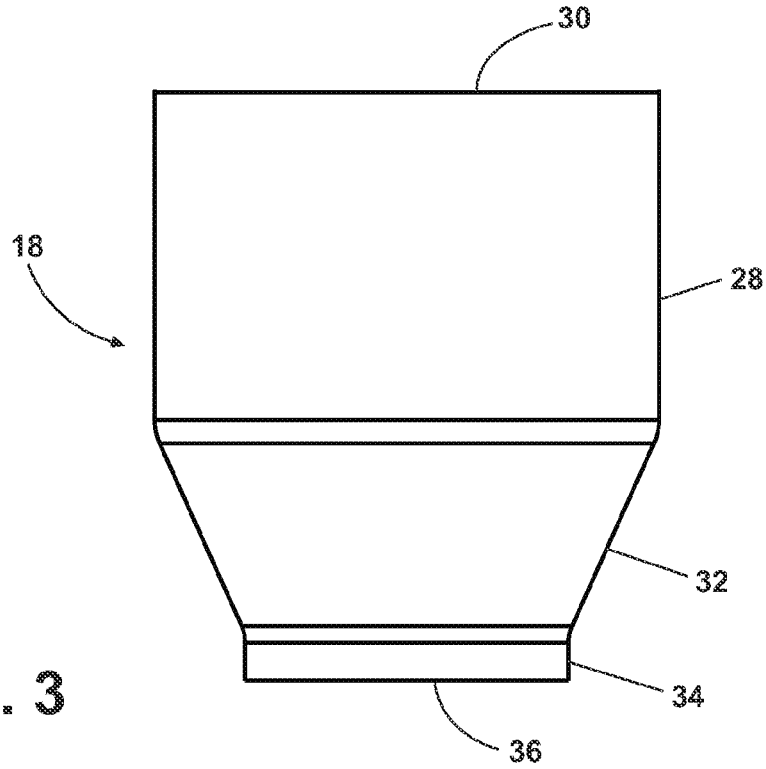
FIG. 3 is a side view of a first end section of the auger casing.
Figure 5:
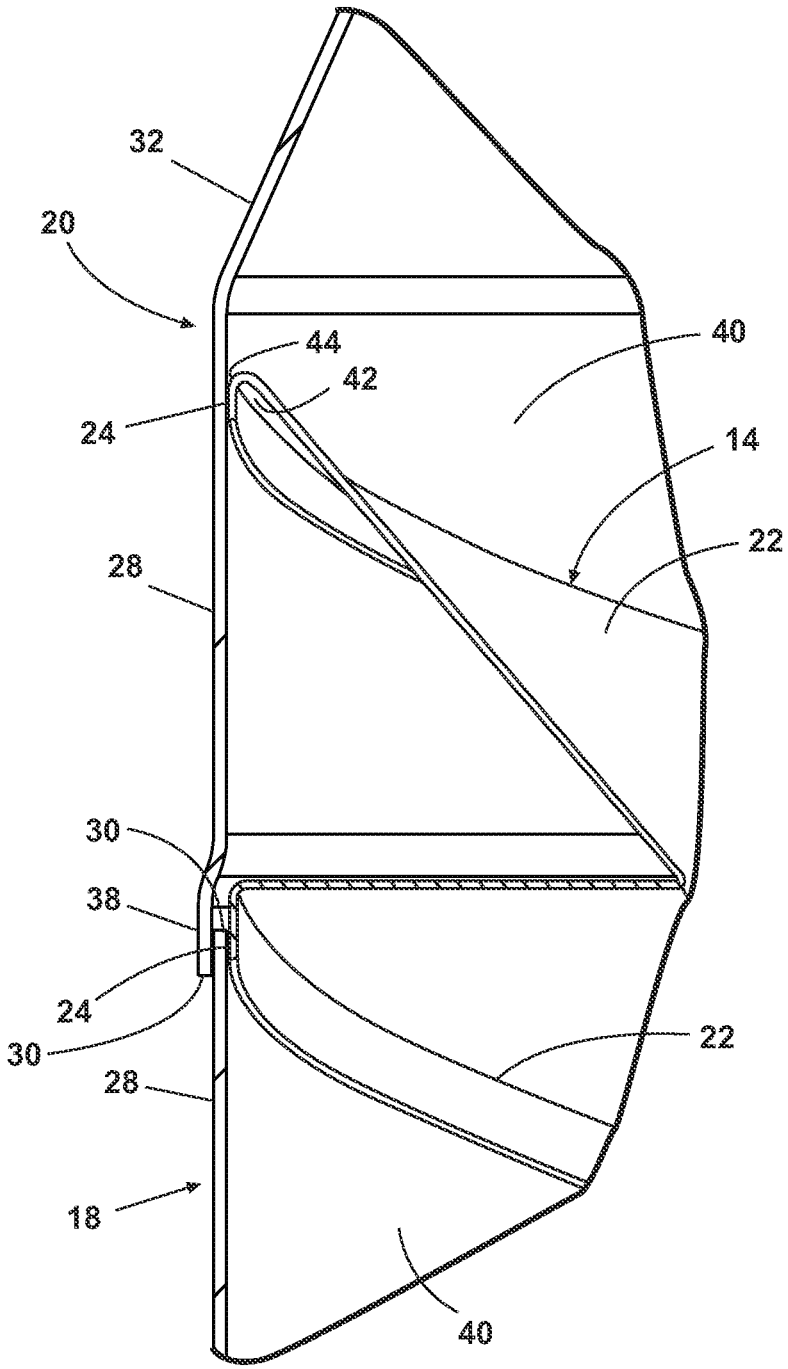
FIG. 5 is close-up cross sectional view through the fixed auger assembly.

At least one of the end sections 18, 20, and preferably both so that they are also substantially identical, comprises a cylindrical portion 28 defining a first open end 30, a frusto-conical portion 32 joined with the cylindrical portion opposite the first open end 30, and a collar 34 joined with the frusto-conical portion 32 and defining a second open end 36. Each end section 18, 20 is preferably forming by draw forming a metal tube to the shape illustrated in FIG. 3, showing the first end section 18. Each end section 18, 20 has a generally circular cross-section, with the cylindrical portion 28 preferably having the largest cross-sectional area. In such case, the cross-sectional area of the frusto-conical portion 32 decreases towards the collar 34, which has the smallest cross-sectional area. Preferably, the end sections 18, 20, like the auger blades 12, 14, are formed from a 300 series stainless steel to resist corrosion caused by exposure to the urea injected into the exhaust air stream.

Referring to FIG. 3, the second end section 20 preferably undergoes a further forming step in which a flared portion 38 is formed on the cylindrical portion 28, adjacent the first open end 30. The flared portion 38 is configured to receive a portion of the cylindrical portion 28 adjacent the first open end 30 of the first end section 18. The formation of the flared portion 38 can selectively be done during the draw forming process. Thus, during mass production of the fixed auger assembly 10, half of the end sections can be formed without the flared portion 38 to make a batch of the first end section 18 and the other half can be formed with the flared portion 38 to make a batch of the second end section 20.

To assemble the fixed auger assembly 10, the auger blades 12, 14 are affixed to the inside surface of a first of the end sections 18 or 20 by any conventional joining means, including spot welding and resistance welding. It will be apparent that the diameter of each auger blade 12, 14 will be nominally the same as the inside diameter of the cylindrical portion 28 of each end section 18, 20. Specifically, the annular lip 24 of each auger blade 12, 14 is oriented generally parallel to an inside surface 40 of the cylindrical portion 28 of one of the end sections 18, 20 and joined therewith. The annular lip 24 allows greater freedom in selecting the type of joining means between the auger blades 12, 14 and the auger casing 16. Furthermore, if a welding process is used, a weld bead 44 can be located at the annular lip 24 and the inside surface 40 of the cylindrical portion 28 at the radiused corner 42 to minimize its exposure to the corrosive exhaust air stream containing urea. The auger blades 12, 14 can further also be welded or otherwise affixed to one another at their respective centers. Preferably the auger blades 12, 14 and the one end section 18 or 20 are dimensioned so that a portion of the auger blades will extend from the open end 30 of the cylindrical portion 28.

The second of the end sections 18 or 20 is then added to complete the fixed auger assembly 10 by inserting the first open end 30 of the first end section 18 into the flared portion 38 of the second end section 20 with the exposed auger blades extending into the second of the end sections 18 or 20. Preferably, a welding process or other conventional means will secure the two end section 18, 20 at the open end 30 and flared portion 38. The auger blades 12, 14 are also affixed to the inside surface 40 of the other end section 18, 20 by securing, as by welding, the annular 24 of each of each auger blade 12, 14 to the inside surface of the cylindrical portion 28 of the other end section 18, 20. It will be apparent that other assembly steps are within the scope of the invention. For example, an auger blade 12 or 14 can first be secured to an inside surface of each end section 18, 20, then the end sections can be adjoined at their respective open ends 30 in a twisting movement so that the auger blades 12, 14 entwine to form the helical air flow path. The centers of the auger blades 12, 14 are then secured to each other as are the open ends 30.

Since the fixed auger assembly 10 comprises only four components—the auger blades 12, 14 and the two end sections 18, 20 of the auger casing 16—less time and labor is required for assembly. Further, since the auger blades 12, 14 are identical, and therefore interchangeable, and the two end sections 18, 20 are identical with the exception of the flared portion 38, the assembly process is further simplified. Manufacturing of the components of the fixed auger assembly 10 is also simplified since the auger blades 12, 14 are identical and can be made using the same tooling equipment and processing cycle, and the end sections 18, 20 are identical, with the exception of the flared portion 38, and can be made using the same tooling equipment and a processing cycle that is only slightly modified to make the flared portion 38 on the second end section 20.

While the invention has been specifically described in connection with certain specific embodiments thereof, it is to be understood that this is by way of illustration and not of limitation, and the scope of the appended claims should be construed as broadly as the prior art will permit.

What is claimed is:

1. A fixed auger assembly for use in an exhaust line of an internal combustion engine where an additive is added to the exhaust stream, the fixed auger assembly comprising:

first and second end sections, each end section having a first open end and a second open end wherein each second open end is adapted to join to an exhaust line, and a cylindrical portion with an inside surface, the first and second end sections joined to each other at the first open ends to form a casing, and first and second auger blades, wherein the first auger blade is secured to the inside surface of the first end section and the second auger blade is secured to the inside surface of the second end section in facing relationship to each other to form a double helical airflow path through the auger blades wherein the two auger blades will cause turbulent airflow to facilitate mixing the additive to the exhaust stream within the assembly when installed in an exhaust line.

2. A fixed auger assembly according to claim 1 wherein at least one of the second open ends is connected to an adjacent cylindrical portion by a frusto-conical portion.

3. A fixed auger assembly according to claim 1 wherein the auger blades are spiraled at an angle of between 270° and 360°.

4. A fixed auger assembly according to claim 1 wherein each auger blade has an annular lip that is secured to the inner surfaces.

5. A fixed auger assembly according to claim 1 formed of 300 series stainless steel.

6. A fixed auger assembly according to claim 1 where cylindrical portions at the inside surfaces are of larger diameter than the second open end.

7. A fixed auger assembly according to claim 6 wherein at least one of the second open ends is connected to the adjacent cylindrical portion by a frusto-conical portion.

8. A fixed auger assembly according to claim 7 wherein one of the first open ends has a flared portion into which the other can be received.

9. A fixed auger assembly according to claim 8 wherein the auger blades are spiraled at an angle of between 270° and 360°.

10. A fixed auger assembly according to claim 9 wherein each auger blade has an annular lip that is secured to the inner surfaces.

11. A fixed auger assembly according to claim 10 wherein the annular lip secured to the inner surfaces by welding at a radiused corner.

12. A fixed auger assembly according to claim 11 formed of 300 series stainless steel.

13. A fixed auger assembly according to claim 1 wherein one of the first open ends has a flared portion into which the other first open end can be received.

14. A fixed auger assembly according to claim 13 wherein the annular lip secured to the inner surfaces by welding at a radiused corner.

15. In an exhaust line of an internal combustion engine where an additive is mixed to exhaust air in the exhaust line, the improvement comprising:

a fixed auger assembly disposed in the exhaust line downstream of where the additive is added to the exhaust stream, the fixed auger assembly having first and second end sections, each end section having a first open end and a second open end wherein each second open end is joined to the exhaust line, and a cylindrical portion with an inside surface, wherein the first and second end sections are joined to each other at the first open ends, and first and second auger blades, wherein the first auger blade is secured to the inside surface of the first end section and the second auger blade is secured to the inside surface of the second end section in facing relationship to each other to form a double helical airflow path through the auger blades whereby to cause turbulent airflow to facilitate mixing the additive to the exhaust stream within the assembly.

16. A method of making a fixed auger assembly for use in an exhaust line of an internal combustion engine where an additive is added to the exhaust stream, the method comprising:

draw forming first and second end sections, each end section having a first open end and a second open end wherein the second open end is adapted to join to an exhaust line, and a cylindrical portion with an inside surface;

draw forming one of the first open ends to form a flared portion;

stamping first and second auger blades, each auger blade formed into a spiral extending at an angle of between 270° and 360° and having an annular lip;

securing the annular lip of each blade to a respective inside surface of the first and second end sections; and securing the first open ends to each other at the flare portion.

* * * * *

UNITED STATES PATENT AND TRADEMARK OFFICE

CERTIFICATE OF CORRECTION

PATENT NO. : 8,484,948 B2
APPLICATION NO. : 12/531089
DATED : July 16, 2013
INVENTOR(S) : Michael D. Kozal It is certified that error appears in the above-identified patent and that said Letters Patent is hereby corrected as shown below:

In the Specification

Column 1, lines 47-58, under SUMMARY OF THE INVENTION, reads: A simplified fixed auger assembly (10) is provided. According to the invention, the fixed auger assembly (10) comprises a pair of identical auger blades (12, 14) mounted within an auger casing (16). The auger casing (16) includes two end sections, (18, 20) which are substantially identical, with the exception that one end seciton (20) is formed with a flared edge (38) to partially receive the other end section (18). The auger baldes (12, 14) preferably include a peripheral annular lip (24) which is used to affix the auger baldes with in the auger casing. The auger baldes (12,14) and the end sections (18, 20) are preferably assembled using a welding process.

It should read, under SUMMARY OF THE INVENTION:

A fixed auger assembly is described for use in an exhaust line of an internal combustion engine where an additive is added to the exhaust stream. In one embodiment, the fixed auger assembly comprises first and second end sections, each end section having a first open end and a second open end. Each second open end is adapted to join to an exhaust line. Each end section also has a cylindrical portion with an inside surface. The first and second end sections are joined to each other at the first open ends to form a casing. The fixed auger assembly also comprises first and second auger blades. The first auger blade is secured to the inside surface of the first end section and the second auger blade is secured to the inside surface of the second end section. The auger blades are secured in facing relationship to each other to form a double helical airflow path through the auger blades where the two auger blades will cause turbulent airflow to facilitate mixing the additive to the exhaust stream within the assembly when installed in an exhaust line.

In another aspect, an improvement in an exhaust line of an internal combustion engine where an additive is mixed to exhaust air in the exhaust line includes a fixed auger assembly disposed in the exhaust line downstream of where the additive is added to the exhaust stream. The fixed auger assembly has first and second end sections, each end section having a first open end and a second open Signed and Sealed this
Fifteenth Day of October, 2013

Teresa Stanek Rea

Teresa Stanek Rea
*Deputy Director of the United States Patent and Trademark Office* end wherein each second open end is joined to the exhaust line. Each end section also has a cylindrical portion with an inside surface. The first and second end sections are joined to each other at the first open ends. The fixed auger assembly also comprises first and second auger blades. The first auger blade is secured to the inside surface of the first end section and the second auger blade is secured to the inside surface of the second end section in facing relationship to each other to form a double helical airflow path through the auger blades in order to cause turbulent airflow to facilitate mixing the additive to the exhaust stream within the assembly.

In a further aspect, a method of making a fixed auger assembly is described for use in an exhaust line of an internal combustion engine where an additive is added to the exhaust stream. The method includes draw forming first and second end sections, each end section having a first open end and a second open end wherein the second open end is adapted to join to an exhaust line, and a cylindrical portion with an inside surface; draw forming one of the first open ends to form a flared portion; stamping first and second auger blades, each auger blade formed into a spiral extending at an angle of between 270º and 360º and having an annular lip; securing the annular lip of each blade to a respective inside surface of the first and second end sections; and securing the first open ends to each other at the flare portion.